United States Patent [19]

Martin

[11] 4,319,472

[45] Mar. 16, 1982

[54] TUBE END EXPANDER AND METHOD OF OPERATING THE SAME

[75] Inventor: Gregory W. Martin, Williamsville, N.Y.

[73] Assignee: Carrier Corporation, Syracuse, N.Y.

[21] Appl. No.: 128,328

[22] Filed: Mar. 7, 1980

[51] Int. Cl.[3] ..... B21D 39/06

[52] U.S. Cl. ..... 72/122; 72/126

[58] Field of Search ..... 72/122, 123, 393, 126

[56] References Cited

U.S. PATENT DOCUMENTS 1,514,712 11/1924 Maupin ..... 72/122
1,601,329 9/1926 Slesazeck ..... 72/123
2,767,766 10/1956 Mathews .
2,854,058 9/1958 Baker .
3,031,008 4/1962 Schmidt .
3,906,771 9/1975 Martin .

*Primary Examiner*—Lowell A. Larson
*Attorney, Agent, or Firm*—J. Raymond Curtin; John S. Sensny

[57] ABSTRACT

A tube end expander and a method of operating the same. The tube end expander comprises a rotatable, tubular cage defining a plurality of generally axially extending slots, and a plurality of rollers located within the cage and extending through the slots. The expander further comprises a rotatable, tapered mandrel axially extending into the cage in frictional, driving contact with inner surfaces of the rollers, and an auxiliary roller drive for transmitting rotary motion from the mandrel to the cage and rollers.

7 Claims, 2 Drawing Figures

TUBE END EXPANDER AND METHOD OF OPERATING THE SAME

BACKGROUND OF THE INVENTION

This invention generally relates to metal deforming, and more particularly to tube end expanders of the roller and mandrel type.

Tube expanders of the roller and mandrel type are widely used for expanding tube ends into pressure contact with tube sheets. In their usual construction, the roller and mandrel type tube expanders include a tubular cage, a plurality of rollers lying within the cage, and a rotatable, forwardly tapered mandrel axially extending through the cage. The surface of the cage defines a plurality of slots, outer surfaces of the rollers extend through these slots, and inner surfaces of the rollers are in frictional, driving contact with the mandrel. Moreover, the forward end of each roller tapers inward toward the centerline thereof, forming a truncated cone section. With this usual construction, forward movement of the mandrel forces the rollers radially outward while rotation of the mandrel rotates the rollers and the cage. To expand a tube end, the mandrel is axially located relative to the cage and rollers so that the rollers are positioned with outer surfaces thereof defining the circle to which the interior of the tube is to be expanded. The mandrel is then rotated, rotating the rollers and cage. The cage and rollers are axially moved into the inside of the tube until the forward, tapered ends of the rollers come into contact with the inside surface of the tube. Thereafter, with some expanders, rotation of the rollers against and around the interior surface of the tube produces a threading action, pulling the rollers and the cage further into the tube, and with other expanders, the cage and rollers are forced further into the tube. In either case, the forward, tapered ends of the rollers axially move further into the tube, forcing the tube surface radially outward. When tube expansion is completed, the tube expander is withdrawn from the tube either by pulling the expander therefrom or by reversing mandrel rotation to produce a threading action pushing the rollers and cage out of the tube.

Prior art tube end expanders and methods of operating the same of the general type described above have not been completely satisfactory. For example, just as the forward, tapered ends of the rollers exert radially outward forces on the inside surface of the tube, the tube surface exerts radially inward forces on the forward ends of the rollers. These radially inward forces push the forward ends of the rollers toward the mandrel, thus tending to pivot each roller about the inside, base edge of the truncated cone section thereof. Such pivoting action raises the portions of the rollers rearward of the truncated cone sections, decreasing the area of contact, and thus the frictional forces, between the rollers and the mandrel. This contact area may become so diminished that the frictional forces between the rollers and mandrel are insufficient to rotate the rollers.

If this happens, the rollers and cage stop rotating, detrimentally affecting tube expansion. For example, because the rollers and cage stop rotating around the inside surface of the tube, tube expansion becomes nonuniform, resulting in high and low spots. These low spots may result in gaps between the exterior of the tube and a tube sheet through which the tube extends, preventing the development of a good seal therebetween.

Alternately, localized sections of the tube may be excessively expanded, cracking the tube.

SUMMARY OF THE INVENTION

In view of the above, an object of this invention is to improve tube end expanders and methods of operating the same.

Another object of the present invention is to maintain the rollers and cage of a roller and mandrel type tube expander rotating while they move into a tube to expand the end thereof.

A further object of this invention is to transmit rotary motion from the mandrel of a roller and mandrel type tube expander to the rollers and cage thereof via parallel paths.

Still another object of the present invention is to provide a roller and mandrel type tube expander with auxiliary drive means for rotating the rollers and cage of the expander, wherein the auxiliary drive means includes an easily adjustable clutch.

These and other objectives are attained with a tube end expander comprising a rotatable, tubular cage defining a plurality of generally axially extending slots, and a plurality of rollers located within the cage and extending through the slots. The expander further comprises a rotatable, tapered mandrel axially extending into the cage in frictional, driving contact with inner surfaces of the rollers, and auxiliary drive means for trasmitting rotary motion from the mandrel to the cage and rollers.

A DETAILED DESCRIPTION OF THE PREFERRED EMBODIMENT

Figure 1:
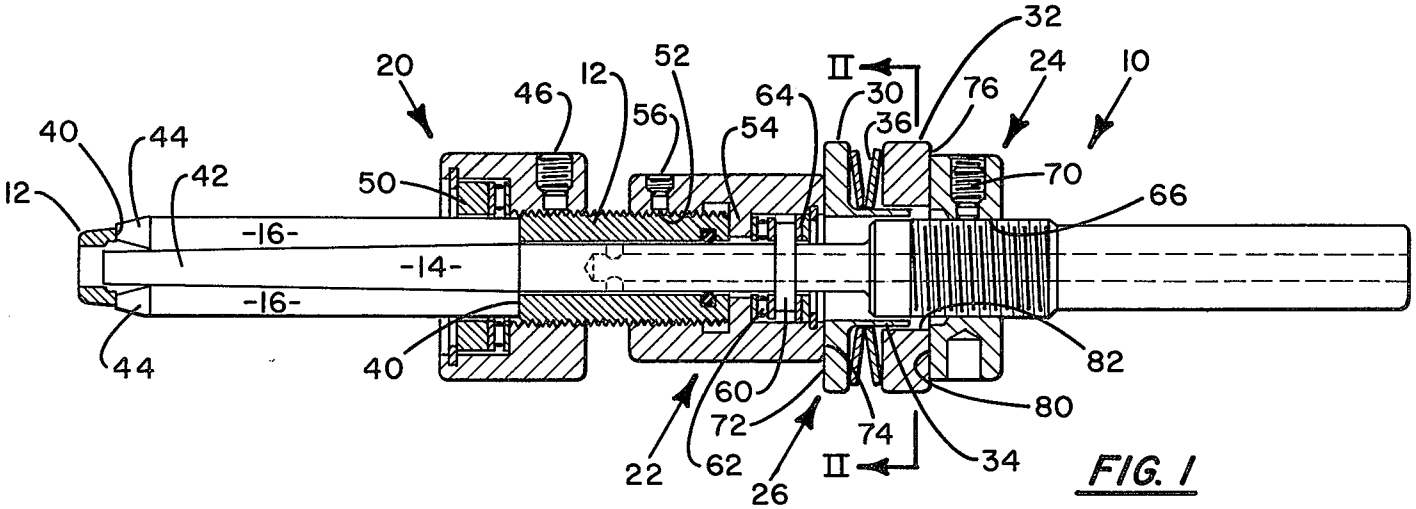
FIG. 1 is a side view partly in cross section of a tube end expander constructed in accordance with a preferred embodiment of the present invention.

Referring to the drawing and particularly to FIG. 1, there is shown tube end expander 10 illustrating a preferred embodiment of the present invention. Tube end expander 10 is of the roller and mandrel type including cage 12, mandrel 14, a plurality of, preferably three, rollers 16, and thrust housing 20. Expander 10 further comprises collar means, including front collar 22 and back collar 24, and clutch member 26. Clutch member 26, in turn, includes front, or first clutch plate 20, back, or second clutch plate 32, tubular member 34, and resilient means such as belville spring 36.

Cage 12 generally is tubular shaped and defines a plurality of, preferably three, generally axially extending, circumferentially spaced slots 40. Mandrel 14 includes a conically shaped, forwardly tapered section 42 which extends into cage 12. Mandrel 14 is rotatable within cage 12 and, in a manner explained below, may be axially moved relative thereto. Rollers 16 are contained within cage 12 and lie therein generally parallel to the centerline thereof. Inner surfaces of rollers 16 are in frictional, driving engagement with tapered section 42 of mandrel 14, and outside surfaces of the rollers extend through slots 40. The width of slots 40, however, is less than the diameter of rollers 16, preventing the rollers from completely passing through the slots. Moreover, the forward end of each roller 16 tapers inward toward the centerline of the roller, forming truncated cone section 44. With the above-discussed arrangement, forward axial movement of mandrel 14 forces rollers 16 radially outward, rotation of the mandrel rotates the rollers, and rotation of the rollers rotates cage 12.

Thrust housing 20 annularly extends around cage 12 and rollers 16 and is secured to the cage via set screw 46. Housing 20 acts as a stop, limiting axial movement of rollers 16 and cage 12 into a tube. Housing 20 also supports retainer ring 50 which is radially disposed between the thrust housing and rollers 16 to further insure that the back ends of the rollers are maintained within cage 12. In addition, retainer ring 50 is rotatable relative to both rollers 16 and thrust housing 20, facilitating relative rotary motion therebetween.

Front collar 22 is axially located rearward of thrust housing 20 and annularly extends around both cage 12 and mandrel 14. More specifically, front collar 22 defines axially extending bore 52 and radially extending flange 54, which extends into bore 52. Cage 12 axially extends into bore 52, and front collar 22 is secured to the cage for unitary rotational and axial movement therewith via means such as set screw 56. Preferably, the surfaces defining bore 52 and the back surface of cage 12 define complementary threads wherein, after loosening set screw 56, the cage can be axially moved by rotating the cage, with flange 54 limiting rearward axial movement of the cage relative to front collar 22.

Mandrel 14 axially extends through bore 52 and is supported by front collar 22 for rotation within the bore. Also, front collar 22 supports mandrel 14 for unitary axial movement therewith. Referring to the preferred embodiment illustrated in the drawing, mandrel 14 includes radial flange 60 axially located rearward of collar flange 54. Bearing means 62 is located within bore 52 radially outside mandrel 14 and axially between flanges 54 and 60. Abutting contact between bearing means 62 and collar flange 54 prevents forward movement of the bearing means, and abutting contact between the bearing means and mandrel flange 60 prevents forward movement thereof and, thus, of mandrel 14 relative to front collar 22. Bearing means 62 also facilitates relative rotary motion between mandrel 14 and front collar 22. In addition, retaining means 64 is located within bore 52 rearward of mandrel flange 60. Front collar 22 prevents rearward movement of retaining means 64, while abutting contact between the retaining means and mandrel flange 60 prevents rearward movement thereof and, hence, of mandrel 14 relative to the front collar.

Back collar 24 is axially located rearward of and spaced from front collar 22. Back collar 24 defines bore 66, and mandrel 14 axially extends therethrough. Also, back collar 24 is secured to mandrel 14 for unitary rotation therewith via means such as set screw 70. Preferably, the diameter of bore 66 is slightly larger than the diameter of mandrel 14 in the area where back collar 24 is secured thereto. This arrangement provides a slight clearance between back collar 24 and mandrel 14, allowing the back collar, once set screw 70 has been loosened, to axially slide along the mandrel.

Thus, cage 12 rotates with front collar 22, and back collar 24 rotates with mandrel 14—and clutch member 26 is provided for passing rotational motion from the back collar to the front collar. Preferably, clutch member 26 rotates front collar 22, and thus cage 12 and rollers 16, at variable speeds relative to back collar 24, and hence mandrel 14. More particularly, clutch member 26 annularly extends around mandrel 14 and is rotatably supported thereby, and the clutch member is axially positioned between front collar 22 and back collar 24 in frictional contact with both the front and back collars.

Even more particularly, front clutch plate 30, specifically annular surface 72 thereof, is contiguous to and in frictional, abutting contact with rear annular surface 74 of front collar 22; and rear clutch plate 32, specifically annular surface 76 thereof, is in frictional, abutting contact with front annular surface 80 of back collar 24. This frictional engagement between adjacent, contiguous surfaces of clutch member 26 and collar means 22, 24, it should be noted, effectively transmits a continuum of degrees of rotary motion between the clutch member and the collar means. That is, by modulating the frictional force, or pressure, between the contiguous surfaces, the degree of rotary motion transmitted therebetween may also be modulated or gradually varied between zero and substantially unitary. Tubular member 34 extends around mandrel 14, is rotatably supported thereby, and in turn supports front and back clutch plates 30 and 32 for unitary rotation about the mandrel. Tubular member 34 also supports front and back clutch plates 30 and 32 for relative axial movement, and spring 36 is disposed between the front and back clutch plates, urging the plates axially apart into frictional engagement with front and back collars 22 and 24 respectively.

Figure 2:
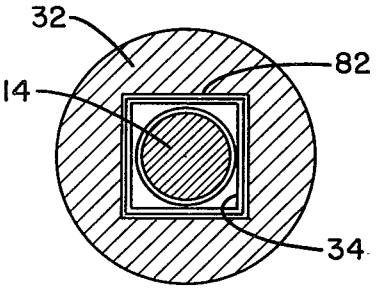
FIG. 2 is a sectional view taken along line II-II of FIG. 1.

Referring to both FIGS. 1 and 2, preferably tubular member 34 is integral with front clutch plate 30 and extends rearward therefrom into opening 82 defined by surfaces of back clutch plate 32. Tubular member 34 defines a generally square shaped cross section and opening 82 also has a generally square shape. Opening 82 is slightly larger than the cross section of tubular member 34, allowing back clutch plate 32 to axially move relative to the tubular member without binding thereagainst while still producing unitary rotation between the back clutch plate, the tubular member, and hence front clutch plate 30.

As discussed above, front collar 22, back collar 24, and clutch member 26 comprise auxiliary drive means for transmitting rotary motion from mandrel 14 to cage 12 and rollers 16. Thus, rotary motion may be transmitted from mandrel 14 to cage 12 and rollers 16 via parallel routes. First, via frictional contact between mandrel 14 and the inner surfaces of rollers 16 and, second, via the above-described auxiliary drive means. If frictional forces between mandrel 14 and the inner surfaces of rollers 16 are greater than the frictional forces between collars 22 and 24 and clutch member 26, then the former forces dominate to drive the rollers and cage 12. Under these conditions, adjacent surfaces of collars 22 and 24 and clutch member 26 rotate relative to each other as may be necessitated by the fact that front collar 22 and back collar 24 unitarily rotate with cage 12 and mandrel 14 respectively.

In contrast, if frictional forces between mandrel 14 and the inner surfaces of rollers 16 are less than the frictional forces between collars 22 and 24 and clutch member 26, then the latter forces dominate and the rollers and cage 12 are driven by the auxiliary drive means. Under these conditions, the frictional forces between collars 22 and 24 and clutch member 26 tend to rotate the collars and clutch member unitarily. However, these frictional forces also allow non-unitary rotation between collars 22 and 24 and clutch member 26, and such non-unitary rotation is caused by forces resisting rotation of rollers 16.

Particularly, back collar 24 is constrained to rotate unitarily with mandrel 14, and the back collar transmits to clutch member 26 a force tending to rotate the clutch member unitarily with the back collar. Similarly, clutch member 26 transmits to front collar 22 a force tending to rotate the front collar unitarily with the clutch member. However, front collar 22 is constrained to rotate unitarily with cage 12. Morever, any force tending to resist rotation of rollers 16 also tends to resist rotation of cage 12 and, thus, rotation of front collar 22. The net rotational force on front collar 22, accordingly, is less than the rotational force transmitted thereto via clutch member 26. As a result, the rotational speed of front collar 22 is less than the rotational speeds of clutch member 26 and back collar 28. Further, as will be appreciated from a review of the above, if the forces resisting rotation of rollers 16 vary, then the relative rotational speeds between front collar 22 and back collar 24 also vary. Accordingly, with this preferred arrangement, clutch member 26 rotates front collar 22 and, therefore, cage 12 and rollers 16 at variable speeds relative to back collar 24 and, thus, mandrel 14.

At this point it may be worth noting that, with the embodiment of expander 10 described above, the frictional forces between collars 22 and 24 and clutch member 26 may be manually adjusted by varying the axial location of back collar 24. Specifically, by moving back collar 24 rearward along mandrel 14, the tension of spring 36 is reduced, reducing the frictional forces between collars 22 and 24 and clutch member 26. In contrast, by moving back collar 24 forward along mandrel 14, the tension of spring 36 is increased, increasing the frictional forces between collars 22 and 24 and clutch member 26.

OPERATION

To use tube expander 10 to expand the end of a tube, set screw 56 is loosened and cage 12 and rollers 16 are axially moved relative to mandrel 14 and the front collar by rotating the cage to thread the cage along the complementary threads between the back end of the cage and the surfaces defining bore 52. This axial movement of cage 12 and rollers 16 along mandrel 14 radially moves the rollers, and the cage and rollers are axially moved until the rollers reach a preselected radial position wherein outer surfaces thereof define the circle to which the tube interior is to be expanded. Then set screw 56 is tightened, locking front collar 22 to cage 12 for unitary axial and rotary movement therewith, and thus securing the cage for unitary axial movement with mandrel 14.

Next, any conventional rotary drive means such as an electric motor is connected to mandrel 14 to rotate the mandrel, rollers 16, and cage 12. Expander 10, specifically cage 12 and rollers 16 thereof, is axially moved into the interior of the tube to bring tapered sections 44 of the rollers into contact with the interior surface of the tube. Tube expander 10 is further moved into the tube, forcing tapered sections 44 thereinto. As tapered sections 44 of rollers 16 move into the tube, the rollers exert radially outward forces on the tube surface, tending to expand the tube; and the tube surface exerts radially inward forces on the rollers, tending to pivot the rollers about the inside base edge of tapered sections 44.

With tube expander 10 of the present invention, even if this pivoting action reduces the frictional forces between the inside surfaces of rollers 16 and mandrel 14 to an extent where these frictional forces are unable to rotate the rollers and cage 12, the cage and rollers are maintained rotating by the rotary motion transmitted thereto via collars 22 and 24 and clutch member 26. It should be noted that if collars 22 and 24 and clutch member 26 are unable to rotate cage 12 and rollers 16 because of the frictional resistance between the rollers and the interior tube surface, then back collar 24 may be adjusted and axially moved closer to front collar 22. This increases the frictional forces between collars 22 and 24 and clutch member 26, increasing the rotational force transmitted thereby to cage 12 and rollers 16.

Thus, rollers 16 continue to move around and against the inside surface of the tube, uniformly expanding the tube end. Once tapered sections 44 of rollers 16 are axially within the tube and the tube surface contacts outer surfaces of the rollers rearward of the tapered sections, these rearward sections of the rollers are forced radially inward back into frictional engagement with mandrel 14, and this frictional engagement again becomes effective to rotate the rollers and cage. When tube expansion is completed, mandrel rotation is terminated and tube expander 10 is pulled rearward out of the tube.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. A tube end expander comprising:

a rotatable, tubular cage defining a plurality of generally axially extending slots;

a plurality of rollers located within the cage and extending through the slots;

a rotatable, tapered mandrel axially extending into the cage in frictional, driving contact with inner surfaces of the rollers; and auxiliary drive means for transmitting rotary motion from the mandrel to the cage and rollers, and including collar means defining a collar surface and including a front collar connected to the cage for rotation therewith, and a back collar connected to the mandrel for rotation therewith, and a clutch member for transmitting rotary motion from the back collar to the front collar and including a first rotatable clutch plate defining a clutch surface contiguous to and in frictional, driving contact with the collar surface for transmitting a continuum of degrees of rotary motion between the clutch and collar surfaces, a second rotatable clutch plate axially spaced from the first clutch plate and in driving engagement with the collar means to transmit rotary motion between the collar means and the second clutch plate, means connecting the first and second clutch plates for unitary rotation, and resilient means disposed between the first and second clutch plates, urging the clutch plates axially apart, and urging the clutch surface into frictional contact with the collar surface.

2. A tube end expander as defined by claim 1 further including means to adjust the tension of the resilient means to modulate the magnitude of the frictional force between the clutch surface and the collar surface to vary the rotational speed of the cage and rollers relative to the mandrel.

3. A tube end expander as defined by claim 2 wherein:

the means connecting the first and second clutch plates supports the clutch plates for relative axial movement;

and the means to adjust the tension of the resilient means includes means for adjustably locating the second clutch plate relative to the first clutch plate.

4. A tube end expander as defined by claim 3 wherein:

the second clutch plate defines an opening; and the means connecting the first and second clutch plates includes a tubular member extending from the first clutch plate into the opening defined by the second clutch plate.

5. A tube end expander as defined by claim 3 wherein the means for adjustably locating the second clutch plate includes means adjustably connecting the back collar to the mandrel for changing the axial location of the back collar and the second clutch plate.

6. A method of operating a tube end expander of the type having a rotatable, tubular cage defining a plurality of generally axially extending slots, a plurality of rollers located within the cage and extending through the slots, a rotatable, tapered mandrel axially extending into the cage in frictional, driving contact with inner surfaces of the rollers, and an auxiliary drive means including collar means and a clutch member, wherein the collar means includes a front collar connected to the cage for rotation therewith, and a back collar connected to the mandrel for rotation therewith, and the clutch member is located between the front and back collars and includes resilient means urging the clutch member into frictional, driving engagement with the collar means to transmit rotary motion from the back collar to the front collar, the method comprising the steps of:

rotating the mandrel to rotate the rollers and cage via frictional contact between the mandrel and the roller;

transmitting rotational force from the mandrel to the rollers and cage via the auxiliary drive means;

and adjusting the tension of the resilient means to vary the magnitude of the frictional forces between the clutch member and the collar means to modulate the degree of rotary motion transmitted from the mandrel to the rollers and cage via the auxiliary drive means.

7. A method as defined by claim 6 wherein the adjusting step includes the step of adjusting the position of the back collar.

* * * * *